US011658431B2

(12) United States Patent
Gondo

(10) Patent No.: US 11,658,431 B2
(45) Date of Patent: May 23, 2023

(54) CONNECTOR AND CONNECTOR PAIR

(71) Applicant: Molex, LLC, Lisle, IL (US)

(72) Inventor: Daishi Gondo, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 17/242,510

(22) Filed: Apr. 28, 2021

(65) Prior Publication Data

US 2021/0351527 A1 Nov. 11, 2021

(30) Foreign Application Priority Data

May 11, 2020 (JP) ..... JP2020-082998

(51) Int. Cl.

| | |
|---|---|
| ***H01R 12/71*** | (2011.01) |
| ***H01R 12/73*** | (2011.01) |
| ***H01R 13/502*** | (2006.01) |
| ***H01R 13/04*** | (2006.01) |
| ***H01R 13/11*** | (2006.01) |
| ***H01R 12/57*** | (2011.01) |

(52) U.S. Cl.

CPC ..... *H01R 12/716* (2013.01); *H01R 12/57* (2013.01); *H01R 12/73* (2013.01); *H01R 13/04* (2013.01); *H01R 13/11* (2013.01); *H01R 13/502* (2013.01)

(58) Field of Classification Search

CPC ..... H01R 12/716; H01R 12/57; H01R 12/73; H01R 13/04; H01R 13/11; H01R 13/502; H01R 13/20; H01R 12/707; H01R 13/405; H01R 13/62; H01R 12/70; H01R 24/00

See application file for complete search history.

(56) References Cited

U.S. PATENT DOCUMENTS

| | | | | |
|---|---|---|---|---|
| 10,249,969 | B2 * | 4/2019 | Ono | H01R 13/504 |
| 10,594,077 | B2 * | 3/2020 | Tanaka | H01R 13/6273 |
| 10,651,581 | B1 * | 5/2020 | Sasayama | H01R 13/631 |

(Continued)

FOREIGN PATENT DOCUMENTS

| | | | |
|---|---|---|---|
| CN | 203039120 | U | 7/2013 |
| JP | 3368471 | B2 | 1/2003 |

(Continued)

*Primary Examiner* — Abdullah A Riyami
*Assistant Examiner* — Nelson R. Burgos-Guntin

(57) ABSTRACT

A connector that is easy to manufacture, does not cause short molds, does not cause flux to adhere to the contact part of the terminals, and enables for miniaturization and high reliability. A connector body and a plurality of terminals attached to the connector body are provided; the connector main body is a member integrated with the terminals by insert molding, and includes a protruding part extending in the longitudinal direction thereof that retains the terminals, and a flange protruding outward in the width direction from a side surface of the mounting surface side end of the connector main body. The terminal includes a standing part in which a surface is exposed on a side surface of the protruding part, and a tail part connected to the mounting surface side end of the standing part via a curved connecting part, extending outward in the width direction from the flange, and a tail part soldered to a substrate. The flange includes a notch formed at a location corresponding to each terminal, and the tail part, the curved connecting part, and at least a part of the surface of the standing part are exposed in the notch.

12 Claims, 7 Drawing Sheets

(56) References Cited

U.S. PATENT DOCUMENTS

| | | | | |
|---|---|---|---|---|
| 10,741,956 | B2 * | 8/2020 | Matsuno | H01R 12/73 |
| 11,233,346 | B2 * | 1/2022 | Gondo | H01R 13/6395 |
| 2013/0344710 | A1 * | 12/2013 | Sasaki | H01R 12/716 439/65 |
| 2016/0294082 | A1 * | 10/2016 | Matsuno | H01R 12/7005 |
| 2018/0277972 | A1 * | 9/2018 | Takeuchi | H01R 13/00 |
| 2019/0181572 | A1 * | 6/2019 | Ono | H01R 12/716 |
| 2020/0067227 | A1 * | 2/2020 | Gondo | H01R 13/508 |
| 2020/0127400 | A1 * | 4/2020 | Sasayama | H01R 13/631 |
| 2020/0343659 | A1 * | 10/2020 | Gondo | H01R 24/00 |
| 2020/0343660 | A1 * | 10/2020 | Gondo | H01R 13/405 |
| 2020/0358213 | A1 * | 11/2020 | Tanaka | H01R 12/716 |
| 2020/0373703 | A1 * | 11/2020 | Gondo | H01R 12/716 |
| 2021/0351527 | A1 * | 11/2021 | Gondo | H01R 13/04 |
| 2021/0351528 | A1 * | 11/2021 | Gondo | H01R 13/504 |

FOREIGN PATENT DOCUMENTS

| | | | |
|---|---|---|---|
| JP | 2014170726 | A | 9/2014 |
| JP | 6174005 | B2 | 8/2017 |
| TW | M339799 | U | 9/2008 |
| TW | M403128 | U | 5/2011 |
| TW | I381595 | B | 1/2013 |
| TW | M534909 | U | 1/2017 |

* cited by examiner

Prior art

CONNECTOR AND CONNECTOR PAIR

RELATED APPLICATIONS

This application claims priority to Japanese Patent Application No. 2020-082998, filed on May 11, 2020, the entirety of which is incorporated herein by reference.

TECHNICAL FIELD

The present disclosure relates to a connector and a connector pair.

BACKGROUND

Connectors such as substrate-to-substrate connectors have been used to electrically connect pairs of parallel circuit boards to each other. These types of connectors are attached to each of opposing surfaces of a pair of circuit boards, and fitted together to ensure electric conduction (for example see patent reference 1).

FIG. 7 is a perspective view illustrating a conventional connector.

In the drawing, 811 is a connector housing mounted on a circuit board (not shown), which has a pair of protruding parts 812 that extend in the longitudinal direction thereof. The protruding parts 812 are connected to a top surface of a plate-like bottom plate part 817 that extends in the longitudinal direction of the housing 811, and the dimension in the width direction of which is smaller than the bottom plate part 817.

Furthermore, a plurality of terminals 861 are attached to the protruding parts 812 in the longitudinal direction of the connector. Each terminal 861 has a substantially U-shaped curved contact part 865 and a tail part 862 that is surface mounted to the circuit board. The tail part 862 protrudes outward from the side surface of the bottom plate part 817, and is soldered to a connection pad formed on the surface of the circuit board.

Then, when the connector is mated with a mating connector (not shown), the protruding parts 812 are inserted into each of the pair of recessed grooves formed in the mating housing of the mating connector. As a result, the contact part 865 of the terminals 861 is in contact with and conducts with each of the mating terminals (not shown) mounted side by side in the recessed groove.

Prior Art Documents; Patent Documents; Patent Document 1 Japanese Unexamined Patent Application Publication No. 2014-170726.

SUMMARY

However, in the conventional connector, when the housing 811 is miniaturized, the bottom plate part 817 that protrudes outward from the side surface of the protruding parts 812 becomes thin, which can cause short molding. In other words, in the resin molding process of the housing 811, the part corresponding to the bottom plate part 817 in the molding die is insufficiently filled with resin due to the thinness, and thus the molded bottom plate part 817 can have missing parts or insufficient wall thickness.

Connectors that have parts missing or insufficient wall thickness become unsaleable due to their poor appearance. In addition, when soldering the tail part 862 of the terminal 861, flux rises through the defective area or insufficient wall thickness area of the bottom plate 817, and if the flux adheres to the surface of the contact part 865, contact failure occurs between the terminals 861 and the mating terminals, and conductivity between the terminals 861 and the mating terminals is lost.

Here, an object of the present invention is to solve the problems of the conventional connector, and to provide a connector and a connector pair that are easy to manufacture, does not cause short molding, and where flux does not adhere to the contact part of the terminals.

Therefore, regarding a connector, a connector body and a plurality of terminals attached to the connector body are provided; the connector main body is a member integrated with the terminals by insert molding, and includes a protruding part extending in the longitudinal direction thereof that retains the terminals, and a flange protruding outward in the width direction from a side surface of the mounting surface side end of the connector main body. The terminal includes a standing part in which a surface is exposed on a side surface of the protruding part, and a tail part connected to the mounting surface side end of the standing part via a curved connecting part, extending outward in the width direction from the flange, and a tail part soldered to a substrate. The flange includes a notch formed at a location corresponding to each terminal, and at least the tail part, the curved connecting part, and a part of the surface of the standing part are exposed in the notch.

Furthermore, with regards to another connector, the width of the notch is narrower than the width of at least one of the standing part, the curved connecting part, and the tail part of the terminal.

Furthermore, with regards to still another connector, a contiguous corner that passes through the notch is formed from the tail part to the upper surface of the flange.

Furthermore, with regards to still another connector, the corner is an intersection of two surfaces that intersect each other.

Furthermore, with regards to still another connector, a recessed part is formed between mutually adjacent standing parts on the side surface of the protruding part.

Furthermore, with regards to still another connector, the bottom surface of the recessed part is flush with the top surface.

Furthermore, with regards to still another connector, a connector main body, and a plurality of terminals attached to the connector body are provided; the connector main body is a member integrated with the terminals by insert molding, and includes a protruding part extending in the longitudinal direction thereof and retains the terminals, and a flange protruding outward in the width direction from a side surface of the protruding part at a mounting surface side end of the connector body. The terminal consists of a standing part in which a surface is exposed on the side surface of the protruding part, and a tail part that is connected to the mounting surface side end of the standing part via a curved connecting part, extends outward in the width direction from the flange, and is soldered to a substrate. A recessed part is formed between mutually adjacent standing parts on the side surface of the protruding part and a bottom surface of the recessed part is flush with a top surface of the flange.

Furthermore, with regards to still another connector, the standing part includes a contact part in contact with a mating terminal of the mating connector and the contact part is separated from the upper surface of the flange.

A connector pair consists of a connector according to the present disclosure and a mating connector that mates with such connector.

According to the present disclosure, the connector and the connector pair are easy to manufacture, short molding does not occur, and the flux does not adhere to the contact part of the terminal, and size reduction and improvement in reliability are feasible.

BRIEF DESCRIPTION OF THE DRAWINGS

FIG. 3A is a perspective view, and FIG. 3B is an enlarged view of Part A of FIG. 3A.

FIG. 4A is a top view and FIG. 4B is a side view.

FIG. 5A is an enlarged cross-sectional view taken along line C-C of FIG. 4A, FIG. 5B is an enlarged view of Part F of FIG. 5A, FIG. 5C is an enlarged view of Part E of FIG. 4B, and FIG. 5D is an enlarged cross-sectional view taken along line D-D of FIG. 4A.

FIG. 6A is a perspective view of the second connector and FIG. 6B is a perspective view of the first connector and the second connector mated with each other.

DETAILED DESCRIPTION OF THE PREFERRED EMBODIMENTS

Embodiments will hereinafter be described in detail with reference to the drawings.

Figure 1:
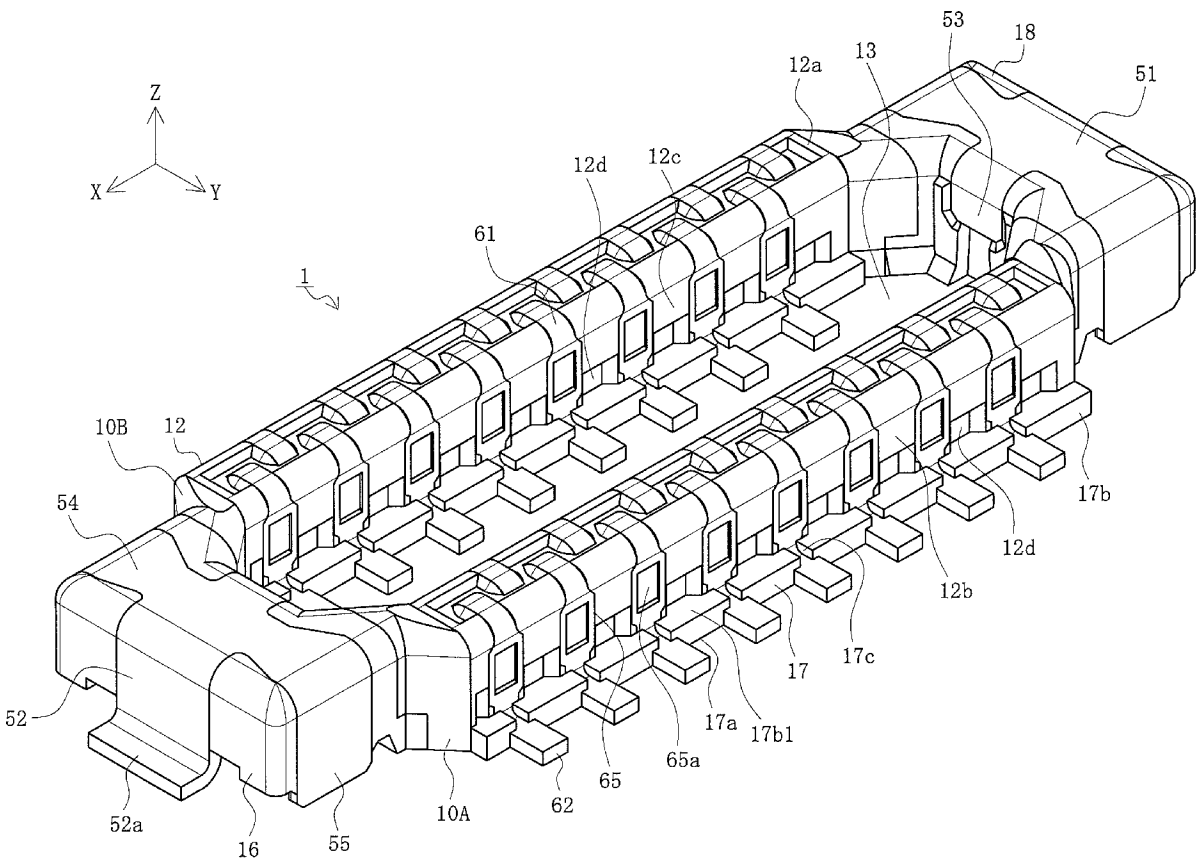
FIG. 1 is perspective view of a first connector according to the present embodiment.
Figure 2:
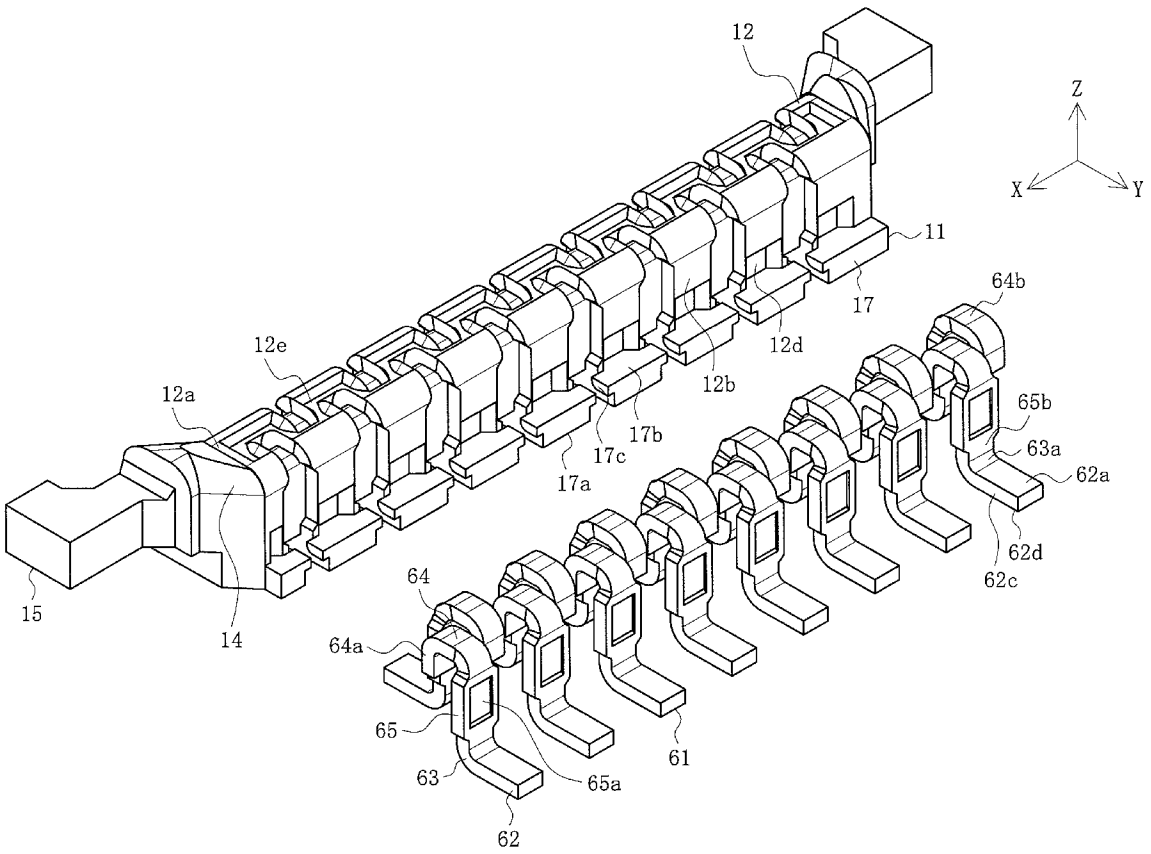
FIG. 2 is an exploded view of a left half body part of the first connector according to the present embodiment.
Figure 3A:
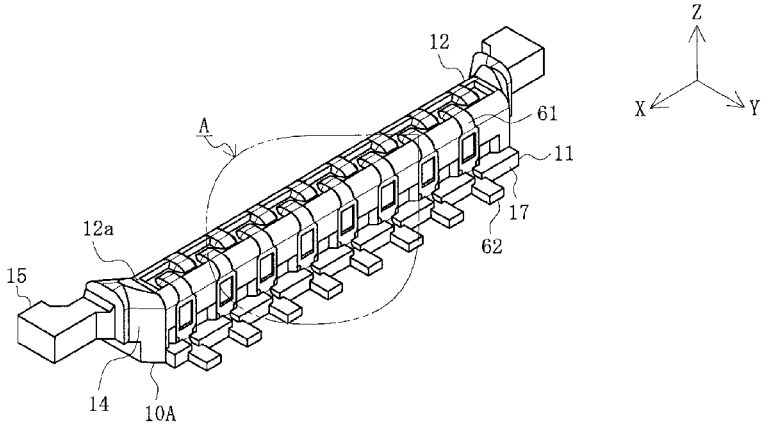
FIGS. 3A and 3B are perspective views of the left half body part of the first connector according to the present embodiment, where
Figure 3B:
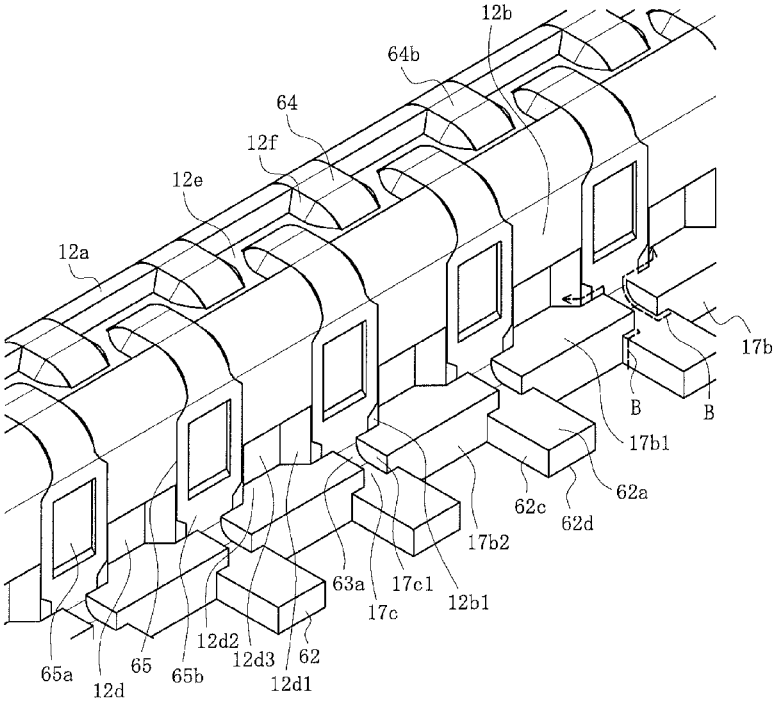
Figure 4A:
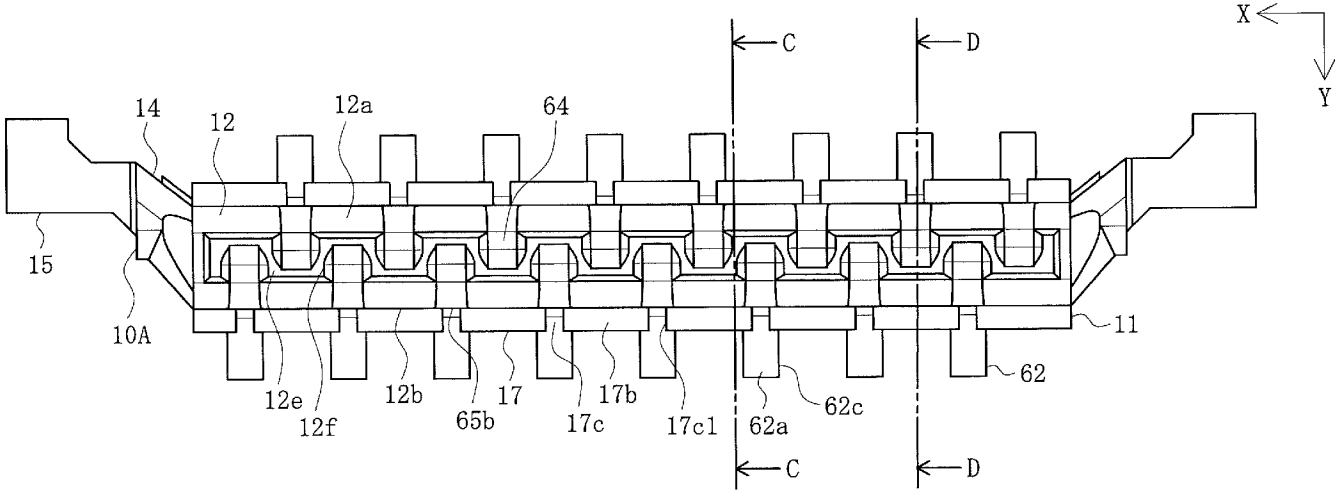
FIGS. 4A and 4B are two-sided views of the left half body part of the first connector according to the present embodiment, where
Figure 4B:
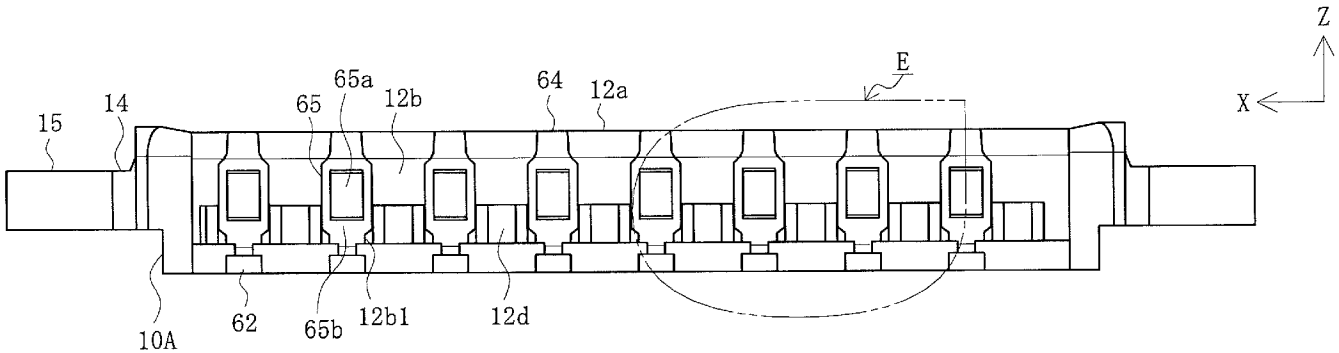
Figure 5A:
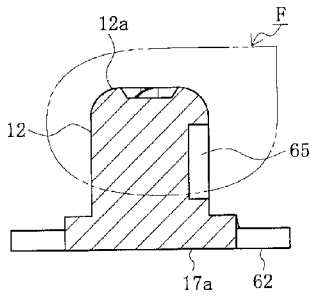
FIGS. 5A-5D are enlarged views of a key part of the left half body part of the first connector according to the present embodiment, where
Figure 5B:
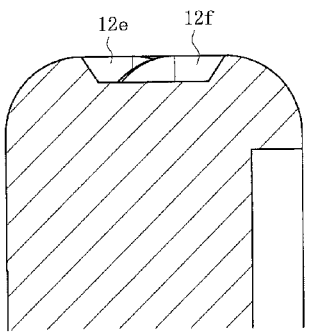
Figure 5C:
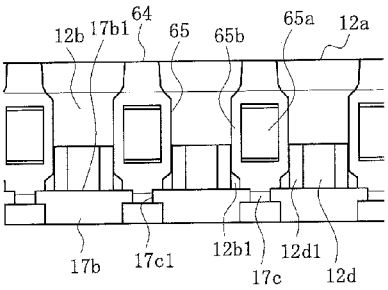
Figure 5D:
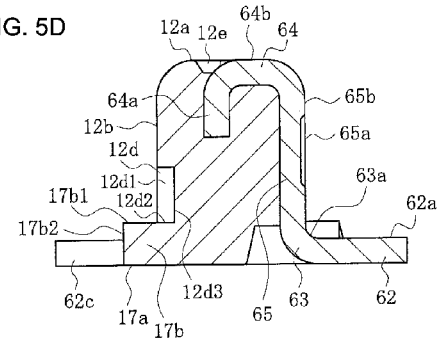

FIG. 1 is a perspective view of the first connector according to the present embodiment. FIG. 2 is an exploded view of the left half body part of the first connector according to the present embodiment. FIGS. 3A and 3B are perspective views of the left half body part of the first connector according to the present embodiment. FIGS. 4A and 4B are two-sided views of the left half body part of the first connector according to the present embodiment. FIGS. 5A-5D are enlarged views of a key part of the left half body part of the first connector according to the present embodiment. Note that in FIGS. 3A and 3B, FIG. 3A is a perspective view, and FIG. 3B is an enlarged view of part A of FIG. 3A. In FIGS. 4A and 4B, FIG. 4A is a top view, and FIG. 4B is a side view. In FIGS. 5A-5D, FIG. 5A is an enlarged cross-sectional view taken along line C-C of FIG. 4A, FIG. 5B is an enlarged view of part F in FIG. 5A, FIG. 5C is an enlarged view of part E of FIG. 4B, and FIG. 5D is an enlarged cross-sectional view taken along line D-D of FIG. 4A.

In the diagrams, 1 is a first connector as one of a pair of board to board connectors, which are connectors in the present embodiment. The first connector 1 is a surface mounting type connector mounted on the surface of a first substrate (not shown) serving as a mounting member and is mated to a second connector 101 (described below) that serves as a mating connector. Furthermore, the second connector 101 is the other of the pair of board to board connectors and is a surface mount type connector mounted on the surface of a second substrate (not shown) serving as a mounting member.

The first connector 1 and the second connector 101 according to the present embodiment are preferably used to electrically connect the first substrate to the second substrate, but can also be used to electrically connect other members. For example, the first substrate and the second substrate each are a printed circuit board, a flexible flat cable (FFC), a flexible circuit board (FPC) or the like as used in electronic devices or the like, but may be any type of substrate.

In addition, in the present embodiment, expressions indicating direction such as top, bottom, left, right, front, rear, and the like used to describe a configuration and operation of each part of the first connector 1 and the second connector 101 are relative rather than absolute, and are proper when each part of the first connector 1 and the second connector 101 are in the positions illustrated in the drawings, however, these directions should be interpreted as being changed according to the change in position when the position thereof is changed.

Furthermore, the first connector 1 is composed of a pair of left and right half body parts, or in other words, a left half body part 10A and a right half body part 10B, joined by a first reinforcement fitting 51 and by a cover part 16 integrally molded by a molding method, called overmolding, outset molding, or insert molding (hereinafter referred to as "insert molding"). Note that as the left half body part 10A and the right half body part 10B are the same members arranged so as to face each other on the left and right sides, they will be described as half body part 10 when described overall. The left half body part 10A and the right half body part 10B each have a substantially gate-shaped shape (a shape projected on the X-Y plane) in a plain view, and the space between the left half body part 10A and the right half body part 10B that are joined together is a long and narrow recessed groove part 13 that extends in the longitudinal direction (X-axis direction) of the first connector 1. The recessed groove part 13 is a through hole that is open on the upper face and the lower face of the first connector 1.

Note that in the present embodiment, for convenience of description, the first connector 1 is described as having a pair of half body parts 10, that is, a configuration in which two of the half body parts 10 are arranged in parallel, but three or more of the half body parts 10 may be arranged in parallel. Furthermore, the half body part 10 need not necessarily have a substantially gate-type shape, and may have any shape provided that both ends in the longitudinal direction can be joined by the first reinforcement fitting 51 and the cover part 16.

The half body part 10 has a first housing 11 as a connector body which is integrally formed by an insulating material such as a synthetic resin and of which shape is substantially gate shaped in plain view. Each first housing 11 includes a narrow long band shaped bottom plate part 17 stretching in the longitudinal direction (X-axis direction) of the first housing 11 and a first protruding part 12 as a narrow long protruding part stretching in the longitudinal direction of the first housing 11 integratedly formed on the upper surface of the bottom plate 17. The first protruding part 12 is a member of which cross section is shaped similar to an upside-down U and has a curved mating surface 12*a* positioned on the top (positive Z-axis direction) and both an outer surface 12*b* and an inner surface 12*c* that are connected to both left and right sides of the mating surface 12*a*. The outer surface 12*b* and the inner surface 12*c* are a pair of flat surfaces that face each other in parallel, and extend in the longitudinal direction of the first housing 11. Note that the dimension in the width direction (Y-axis direction) of the first protruding part 12 is shorter than the dimension in the width direction of the bottom plate part 17, such that the bottom plate part 17 forms a flange 17*b* that protrudes outward in the width direction from the outer surface 12*b* and the inner surface 12*c* at the mounting surface side end of the first protruding part 12, or in other words, the lower end (side end in the negative Z-direction) of the first protruding part 12. Furthermore, the bottom surface of the bottom plate part 17 is a mounting surface 17*a* of the first housing 11 that faces the surface of the first substrate.

In addition, a first terminal 61 as a terminal is disposed on each first protruding part 12. The first terminals 61 are disposed in a prescribed number (16 in the example illustrated in the drawing) and at a prescribed pitch. The first terminal 61 is a member integrally formed by performing processing such as punching and bending on a conductive metal plate, and has a standing part 65 that extends in the vertical direction, a tail part 62 connected to the lower end of the standing part 65 with a curved connecting part 63 that is bent approximately 90 degrees, and an upper end part 64 connected to the upper end of the standing part 65 bent at approximately 90 degrees. Note that an embedded part 64*a* that extends in the downward direction bent at approximately 90 degrees is connected to the tip end of the upper end part 64. The embedded part 64*a* is a part that is embedded in the first protruding part 12 in a downward direction from the mating surface 12*a*.

The tail part 62 extends outward in the width direction from the flange 17*b* of the bottom plate part 17 in the same direction that the surface 65*b* of the standing part 65 faces, and is connected by soldering to a connection pad connected to a conductive trace of the first substrate. The conductive trace is typically a signal line. Furthermore, the center in the vertical direction (Z-axis direction) of the standing part 65 includes a contact recessed part 65*a* that is depressed from the surface 65*b* as an example of a contact part that is a portion that contacts the second terminals 161 (described below) provided by the second connector 101 when the first connector 1 and the second connector 101 are mated. The contact recessed part 65*a* is provided at a distance from an upper surface 17*b*1 of the flange 17*b*.

The first terminal 61 are integrated with the first housing 11 through insert molding. In other words, the first housing 11 is molded by setting the first terminals 61 inside and then filling in the cavity of the metal mold with an insulating material. As a result, the first terminals 61 are integrally mounted to the first housing 11 with the lower surface of the tail part 62 exposed to the mounting surface 17*a*, the surface 65*b* of the standing part 65, the surface 63*a* of the curved connecting part 63, and the upper surface 64*b* of the upper end part 64 exposed to the outer surface 12*b* or inner surface 12*c* of the first protruding part 12 and to the mating surface 12*a*. Note that the surface 65*b* of the standing part 65 and the outer surface 12*b* and the inner surface 12*c* of the first protruding part 12 are formed so as to be substantially flush.

Furthermore, the first terminals 61 mounted on each first protruding part 12 is oriented so that the posture of adjacent objects face opposite the width direction of the first protruding part 12. In the example shown in the diagram, the stance of the first terminal 61 positioned at the front end (X-axis positive direction end) among the first terminals 61 attached to the first protruding part 12 of the left half body part 10A is such that the surface 65*b* of the standing part 65 faces the outside (Y axis positive direction side), and of which the tail part 62 is oriented so as to protrude outward, while the stance of the first terminal 61 that is positioned second from the front end is oriented such that the surface 65*b* of the standing part 65 faces the inside (Y-axis negative direction side), and of which tail part 62 protrudes inward. In this manner, as the first terminals 61 are mounted on the first protruding part 12 arranged in a line in mutually opposing directions, the pitch of the tail parts 62 protruding from both sides of the first protruding part 12 is two times that of the pitch of the first terminal 61. Therefore, connection work by soldering or the like to the connection pad of the first substrate can easily be performed. The pitch of the standing part 65 exposed on the outer surface 12*b* of the first protruding part 12 and the pitch of the standing part 65 exposed on the inner surface 12*c* are also twice the pitch of the first terminal 61.

Note that as the first terminal 61 is a member that will be integrated into the first housing 11 using insert molding or the like, the terminals are not meant to exist separated from the first housing 11, however, note that the terminals are illustrated separately from the first housing 11 in FIG. 2 for convenience of explanation.

Regarding the present embodiment, the flange 17*b* of the bottom plate part 17 is an elongated band extending in the longitudinal direction of the first connector 1 in plain view, however, a notch 17*c* is formed at a location corresponding to each of the first terminals 61, and the surface of the corresponding first terminal 61 is exposed at the notch 17*c*. Specifically, the surface 63*a* of the curved connecting part 63 and the surface 62*a* of the tail part 62 are exposed at the standing part 65.

In this manner, the presence of the notch 17*c* reduces the flow distance of the insulating material filled in the corresponding location of the flange 17*b* within the mold cavity during insert molding, and as such, short molding does not occur, preventing defect points or a shortage of wall thickness in the thinly-walled member flange 17*b*. Therefore, there are no appearance defects in the first housing 11 of the manufactured first connector 1.

Furthermore, the longitudinal dimension, or in other words, the width, of the notch 17*c* in the first housing 11 is formed to be narrower than the longitudinal dimension, or in other words, the width, of the first housing 11 on the surface of the first terminal 61. In the present embodiment, the flange 17*b* covers the surface of the standing part 65, the curved connecting part 63, or the tail part 62, and thus is formed at least narrower than the widths of at least one of these. In this way, a part of the surface of the first terminal 61 can be covered by a part of the flange 17*b*.

By covering a part of the surface of the first terminal 61 from the outside using the flange 17*b*, the first terminal 61 can be more firmly fixed to the first housing 11 as compared to when the surface of the first terminal 61 is exposed with respect to the first housing 11.

As in the present embodiment, when the flange 17*b* covers the surface of the standing part 65, the curved connecting part 63, or the tail 62, the width of the notch 17*c* is preferably smaller than the width of all of the standing part 65, the curved connecting part 63, and the tail part 62.

Also, when the tail part 62 is soldered to a connection pad coupled to the conductive trace of the first substrate by the presence of the notch 17*c*, as indicated by the dotted line B in FIG. 3B, the surface tension and capillary action cause the flux to pass through the corner of the first terminal 61 and the flange 17*b* as a passage, and rises up to the top of the upper surface 17*b*1 of the flange 17*b* and is collected. Here, the flux is collected so as to converge around the corner formed on the surface of the first terminal 61 and the upper surface 17*b*1 of the flange 17 and the corner formed at the notch of the flange 17*b*, but the contact recessed part 65*a* is formed above the upper surface 17*b*1, such that the flux does not reach or adhere to the contact recessed part 65*a* which is the contact part.

Specifically, the flux first squeezes out from the lower surface 62*d* of the tail part 62 facing the surface of the first substrate (not shown), rises through the corner where the end surface 17*b*2 of the flange 17*b* intersects with the side surface 62*c* of the tail part 62, then flows in the longitudinal direction (X-axis direction) of the first housing 11 through the corner where the end surface 17*b*2 of the flange 17*b* intersects with the surface 62*a* of the tail part 62, then flows in the width direction (Y-axis direction) of the first housing 11 through the corner where the side surface 17*c*1 of the notch 17*c* of the flange 17*b* intersects with the surface 62*a* of the tail part 62, rises through the corner where the side surface 17*c*1 of the notch 17*c* of the flange 17*b* intersects with the surface 63*a* of the curved connecting part 63 as well as the surface 65*b* of the standing part 65, then flows in the longitudinal direction of the first housing 11 through the corner where the surface 65*b* of the standing part 65 intersects with the upper surface 17*b*1 of the flange 17*b*, then flows in the longitudinal direction of the first housing 11 through the corner where the lowermost part 12*b*1 of the outer surface 12*b* of the first protruding part 12 intersects with the upper surface 17*b*1 of the flange 17*b*, and finally, is collected centered around a corner away from the surface 65*b* of the contact recessed part 65*a* of the upper surface 17*b*1 of the flange 17*b*. Note that, for convenience of explanation, only the flux flow on the side of the outer surface 12*b* of the first protruding part 12 along the dotted line B indicated as illustrated in FIG. 3B is described, however, the same applies to the flux flow on the side of the inner surface 12*c* of the first protruding part 12.

Furthermore, the longitudinal position of the notch 17*c* in the first housing 11 is formed below the contact part of the first terminal 61, or in other words, in the present embodiment, formed in the same position as the contact recessed part 65*a* in the longitudinal direction of the first housing 11. Then, a place can be provided below the contact part where no corner is formed. Therefore, even when the contact recessed part 65*a* as a contact part and the upper surface 17*b*1 of the flange 17*b* are close to each other, a corner part is not formed in the vicinity of the contact part. As described above, the flux flows through the corner and is also collected centered around a corner, such that flux flows away from the contact part and becomes collected, allowing the flux to move away from the contact part.

In order to enable a larger amount of flux to be collected, it is desirable that a side surface recessed part 12*d*, which is a recessed part that functions as a flux collecting recessed part, be formed between the standing parts 65 of the first terminals 61 adjacent to each other on the outer surface 12*b* of the first protruding part 12. The side surface recessed part 12*d* is formed at a part of the outer surface 12*b* that comes into contact with the upper surface 17*b*1 of the flange 17*b*, and a part of the upper surface 17*b*1 makes up the lower side surface of the side surface recessed part 12*d*. In other words, the bottom surface 12*d*2 of the side surface recessed part 12*d* is flush with the upper surface 17*b*1. As a result, the flux that passes through the corner where the lowermost part 12*b*1 of the outer surface 12*b* of the first protruding part 12 intersects with the upper surface 17*b*1 of the flange 17*b* continues and flows through the corner where the inner surface 12*d*1 and bottom surface 12*d*2 of the side surface recessed part 12*d* intersect to inside the side surface recessed part 12*d*, and further flows along the corner where the back side surface 12*d*3 and the bottom surface 12*d*2 of the side surface recessed part 12*d* intersect or the corner where the inner surface 12*d*1 intersects with the back surface 12*d*3 and is collected in the side surface recessed part 12*d*. Therefore, the flux rising from the surface of the first substrate can be collected in the side surface recessed part 12*d* even in large quantities, and thus the adhesion of the flux to the contact recessed part 65*a* of the first terminal 61 can be reliably prevented.

An upper end recessed part 12*e* is formed on the curved mating surface 12*a* positioned above the first protruding part 12. The upper end recessed part 12*e* is formed so as to be recessed lower than (Z-axis negative direction) the uppermost part of the mating surface 12*a* as well as the upper surface 64*b* of the upper end part 64 of the first terminal 61 in the same position as the uppermost part with regards to the vertical direction (Z-axis direction). In addition, both side surfaces of the upper end part 64 of the first terminal 61 exposed in the upper end recessed part 12*e* are covered by a cover part 12*f* formed in the upper end recessed part 12*e* of the first housing 11. The surface of the cover part 12*f* is preferably a curved or inclined surface, as illustrated.

In this manner, the upper-end recessed part 12*e* recessed below the upper surface 64*b* of the upper end part 64 of the first terminal 61 is formed on the mating surface 12*a*, such that when the mold is filled with resin during insert molding, the first terminal 61 can be supported by a part of the cavity surface of the mold abutting against the upper surface 64*b*, and when the mold is opened, the first housing 11 integrally molded with the first terminals 61 can be smoothly removed by moving the mold upward with respect to the first terminal 61. In particular, by forming the cover part 12*f*, the first housing 11 integrally formed with the first terminals 61 can be removed from the mold in an exceedingly smooth manner.

Moreover, the first protruding end parts 18, which are main body end parts and function as mating guide parts, are disposed on both ends in the longitudinal direction of the first protruding part 12. The first protruding end parts 18 are members connected to both ends in the longitudinal direction of each first protruding part 12 and is formed to join the left half body part 10A and the right half body part 10B. Moreover, in a state in which the first connector 1 and the second connector 101 are mated, the first protruding end part 18 functions as an insertion protruding part that is inserted into a mating recessed part 122 (described below) of the second protruding end part 121 of the second connector 101.

The first protruding end part 18 consists of an extension end part 14 of the left and right half body parts 10, an embedded part 15, as well as a cover part 16 and a first reinforcement fitting 51.

The extension end parts 14 that extend in the longitudinal direction are respectively integrally connected to both ends in the longitudinal direction of the first protruding part 12 of the half body part 10, and the embedded parts 15 further extending in the longitudinal direction of the first protruding part 12 are respectively integrally connected to each extension end part 14. Note that the extension end parts 14 extend inclined obliquely inward, the embedded parts 15 extend in the longitudinal direction from an inwardly-eccentric position at the tip of the extension end parts 14, and are positioned inward from the outer surface 12*b* of the first protruding part 12. In other words, the extension end part 14 of the left half body part 10A extends obliquely in the right direction (Y-axis negative direction), and the embedded part 15 extends longitudinally from a position eccentric in the right direction at the tip of the extension end part 14. In addition, the extension end part 14 of the right half body part 10B extends obliquely in the left direction (Y-axis positive direction), and the embedded part 15 extends longitudinally from a position eccentric in the left direction at the tip of the extension end part 14.

Furthermore, at least a part of the extension end part 14 of the left and right half body parts 10 and the entirety of the embedded part 15 are covered by a cover part 16 formed from an insulating material such as a synthetic resin or the like. Specifically, the cover part 16 is formed by a secondary insert molding in which the first terminals 61 and the first housing 11 are integrated, or in other words, by bringing the embedded parts 15 in the left and right half body parts 10 formed by the first insert molding into proximity with each other and covered by the first reinforcement fitting 51 to form the cover part 16. As a result, the extension end part 14 and the embedded part 15 of the left and right half body parts 10, and the first protruding end part 18, in which the cover part 16 and the first reinforcement fitting 51 are integrated, are formed, and the left and right half body parts 10 are joined.

In this manner, as the extension end part 14 extends inwardly at an oblique incline and the embedded part 15 is positioned inwardly from the outer surface 12*b* of the first protruding part 12, the width (dimension in the Y-axis direction) of the first protruding end part 18 can be made smaller than the width (distance between the outer surface 12*b* of the left and right first protruding parts 12) of the first connector 1. Note that in a case where the width of the first protruding end part 18 need not be smaller than the width of the first connector 1, the extension end part 14 does not necessarily have to be inclined obliquely inward, and can be extended directly. Furthermore, the extension end part 14 can be omitted by extending the embedded part 15 directly from both ends in the longitudinal direction of the first protruding part 12. In this case, the longitudinal dimension of the first connector 1 can be shortened. Furthermore, when three or more half body parts 10 are arranged in parallel, the extension end part 14 can be extended so as to have a Y-shape from both ends in the longitudinal direction of the first protruding part 12.

The first reinforcement fitting 51 is a member integrally formed by punching, bending, or the like of a metal plate, and includes a substantially rectangular top plate 54 that extends in the width direction of the first housing 11, a substantially rectangular leg part 55 connected to both the left and right edges of the top plate 54 and that extends downwardly, is connected to both the front and rear edges of the top plate 54, and includes the end wall outer cover part 52 and end wall inner cover part 53 that extend downwardly. Note that a tail part 52*a* is connected to the lower end of the end wall outer cover part 52. The tail part 52*a* is connected to the lower end of the end wall outer cover part 52 and is bent at an angle of approximately 90° therefrom, extends outwardly in the longitudinal direction of the first housing 11, and is connected by soldering to a connection pad connected to a conductive trace of the first substrate. Note that the conductive trace is typically a power line.

Furthermore, the notch 17*c* of the flange 17*b* can be omitted as appropriate in a case where short molding does not occur based on the thickness of the flange. In this case, even if flux from soldering comes up on the upper surface 17*b*1 of the flange 17*b*, the flux is collected centered around the corner of the outer surface 12*b* of the protruding part 12 or surface 65*b* of the standing part 65 intersecting with the upper surface 17*b*1, and is collected away from the contact recessed part 65*a*. Furthermore, if there is a large amount of flux, the flux can be collected in the side surface recessed part 12*d*, thus preventing the flux from adhering to the contact recessed part 65*a*.

Next is an explanation of the configuration of the second connector 101, which comprises a connector pair together with the first connector 1, and the operation of mating the first connector 1 and the second connector 101.

Figure 6A:
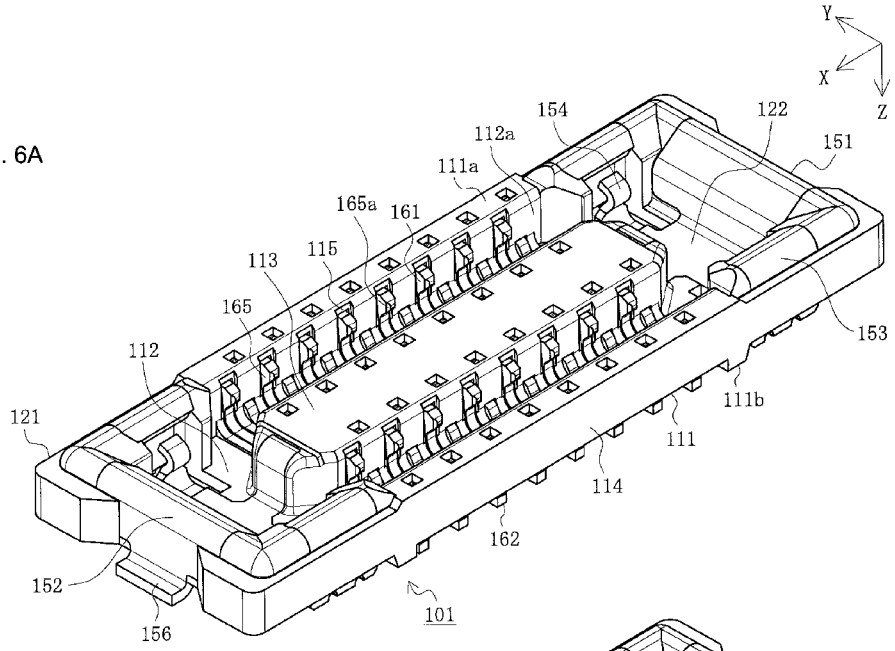
FIGS. 6A and 6B are perspective views describing the mating of the first connector to the second connector according to the present embodiment, where
Figure 6B:
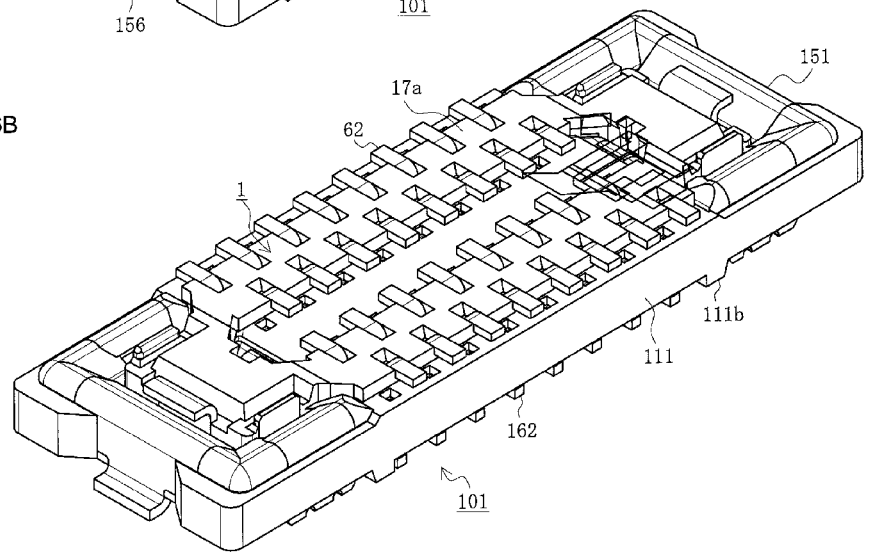
Figure 7:
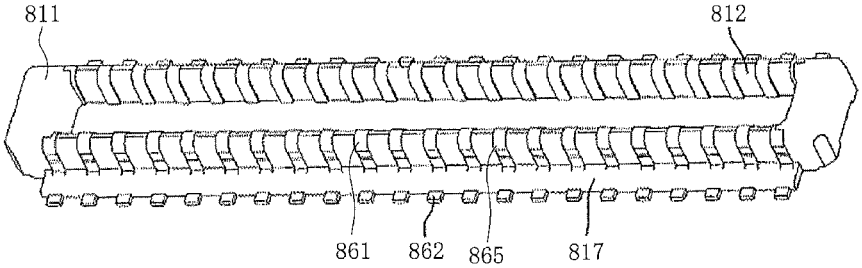
FIG. 7 is a perspective view illustrating a conventional connector.

FIGS. 6A and 6B are perspective views illustrating the mating of the first connector and the second connector according to the present embodiment. Note that in the diagram, FIG. 6A is a perspective view of the second connector, and FIG. 6B is a perspective view of the first connector and the second connector mated to each other.

The second connector 101 as a counterpart connector according to the present embodiment has a second housing 111 as a counterpart connector body integrally formed of an insulating material such as synthetic resin. As illustrated in the figure, the second housing 111 has a substantially rectangular thick plate-like shape that is a substantially rectangular parallelepiped. Furthermore, the side of the second housing 111 where the first connector 1 is inserted into, or in other words the side of the mating surface 111*a* (Z-axis negative direction), is a substantially rectangular recessed part 112 with an enclosing periphery, forming the recessed part 112 to be mated with the first housing 11. Inside the recessed part 112 is the second protruding part 113, as an insular part to be mated with a recessed groove part 13, that is integrally formed with the second housing 111, and in addition, side wall parts 114 extending in parallel with the second protruding part 113 on both sides of the second protruding part 113 are integrally formed with the second housing 111.

The second protruding part 113 and the side wall parts 114 protrude upwardly (Z-axis negative direction) from the bottom surface of the recessed part 112, and extend in the longitudinal direction of the second connector 101. Consequently, a recessed groove part 112*a* that is an elongated recessed part extending in the longitudinal direction (X-axis direction) of the second connector 101 is formed as a part of the recessed part 112 on both the sides of the second protruding part 113. A second terminal stowing cavity 115 with a recessed groove shape is formed on both sides of the second protruding part 113 and on the inner side surface of the side wall parts 114 to stow the second terminals 161 which are the counterpart terminals. The second terminal stowing cavities 115 are disposed at a pitch corresponding to the first terminals 61 and at the corresponding appropriate number.

The second terminal 161 is a member integrally formed by applying a process such as punching or the like to a conductive metal plate, and consists of a main body part, a tail part 162 connected to the bottom end of the main body part, a connecting part that extends in the width direction (Y-axis direction) of the second connector 101 from close to the bottom end of the main body part, and a contact part 165 that extends upwards (Z-axis positive direction) from the connecting part. Note that it is preferable for a contact protruding part 165*a* that protrudes towards the main body part to be formed near the tip of the contact part 165. The main body part is a part that is press-fit and retained in the second terminal stowing cavity 115. In addition, the tail part 162 is bent and connected to the lower end of the main body part, extends in the width direction of the second housing 111, and connected by soldering or the like to a connection pad that is connected with the conductive trace of the second substrate. The conductive trace is typically a signal line. Furthermore, the contact part 165 is a part in contact with the first terminal 61 equipped on the first connector 1 when the first connector 1 and the second connector 101 are mated, and in addition, the contact protruding part 165*a* preferably engages with the contact recessed part 65*a* formed on the standing part 65 of the first terminal 61.

The second terminal 161 is inserted in the second terminal stowing cavity 115 from the lower part of the second housing 111 and mounted in the second housing 111. As a result, the main body part of the second terminal 161 is press-fit into the second terminal stowing cavity 115 and retained, the contact part 165 is exposed to the recessed groove part 112*a*, and the lower surface of the tail part 162 is exposed to a mounting surface 111*b* which is the lower surface of the second housing 111.

In addition, similar to the first terminal 61, the second terminals 161 mounted in each of the recessed groove parts 112*a* are oriented such that the posture of those that are adjacent will face opposing directions in regards to the width direction of the recessed groove part 112*a*. Regarding the example illustrated in FIG. 6A, the posture of the second terminal 161 positioned on the front end (end in the positive X-axis direction) of the second terminal 161 mounted in the recessed groove part 112*a* on the side in the positive Y-axis direction is oriented such that the tail part 162 protrudes in the negative Y-axis direction, and in contrast, the posture of the second terminal 161 positioned 2nd from the front end is oriented such that the tail part 162 protrudes in the positive Y-axis direction. In this manner, as the second terminals 161 are mounted in the recessed groove part 112*a* arranged in a line in alternating directions, the pitch of the tail parts 162 exposed on the mounting surface 111*b* on both sides of the recessed groove part 112*a* is set to twice the pitch of the second terminals 161. Therefore, connection work by soldering or the like to the connection pad of the second substrate can easily be performed. In addition, the pitch of the contact part 165 exposed to the recessed groove part 112*a* is set to twice the pitch of the second terminals 161.

In addition, second protruding end parts 121 are disposed as mating guide parts on each of both ends in the longitudinal direction of the second housing 111. The fitting recess 122 is formed as part of the recess 112 in each second protrusion end 121. The fitting recess 122 is a substantially rectangular recess, and is connected to both the ends in the longitudinal direction of each recessed groove 112*a*. Moreover, in a state in which the first connector 1 and the second connector 101 are mated inside the mating recessed part 122, the first protruding end part 18 provided on the first connector 1 is inserted. A second reinforcement fitting 151 as a counterpart reinforcement fitting is attached to the second protruding end part 121. The second reinforcement fitting 151 is integrated with the second housing 111 by means of insert molding.

The second reinforcement fitting 151 is a member integrally formed by punching, bending, or the like of a metal plate, and has a second main body part 152 extending in the width direction of the second housing 111, a lateral cover part 153 connected to both the left and right ends of the second main body part 152, a contact side part 154 disposed on the left and right inner walls of the mating recessed part 122, and a tail part 156 connected to the lower end of the second main body part 152. The tail part 156 extends towards the outer longitudinal direction of the second connector 101, and is connected by soldering to the connection pad (not shown) which is exposed on the surface of the second substrate. Note that, for example, the connection pad is preferably coupled with the conductive trace, which is a power line.

Subsequently, the operation of mating together the first connector 1 and the second connector 101 with the above configuration will be described.

Here, the tail part 62 of the first terminal 61 of the first connector 1 is connected by soldering to a connection pad (not shown) that is connected to a conductive trace of the first substrate, and in addition, the tail part 52*a* of the first reinforcement fitting 51 is connected by soldering to a connection pad that is connected to a conductive trace of the first substrate, and thus, the first connector 1 is mounted on the surface of the first substrate. Note that the conductive trace connected to the connection pad to which the tail part 62 of the first terminal 61 is connected shall be a signal line, and the conductive trace connected to the connection pad to which the tail part 52*a* of the first reinforcement fitting 51 is connected shall be a power line.

Similarly, the tail part 162 of the second terminal 161 of the second connector 101 is connected by soldering to a connection pad (not shown) that is connected to a conductive trace of the second substrate, and in addition, the tail part 156 of the second reinforcement fitting 151 is connected by soldering to a connection pad that is connected to a conductive trace of the second substrate, and thus, the second connector 101 is mounted on the surface of the second substrate. Note that the conductive trace connected to the connection pad to which the tail part 162 of the second terminal 161 is connected shall be a signal line, and the conductive trace connected to the connection pad to which the tail part 156 of the second reinforcement fitting 151 is connected shall be a power line.

First, an operator opposes the mating surface 12*a* of the first protruding part 12 as the mating surface of the first housing 11 of the first connector 1 and the mating surface 111*a* of the second housing 111 of the second connector 101, and when the position of the first protruding part 12 of the first connector 1 is aligned with the position of the corresponding recessed groove part 112*a* of the second connector 101, and when the position of the first protruding end part 18 of the first connector 1 aligns with the position of the corresponding mating recessed part 122 of the second connector 101, position alignment of the first connector 1 and the second connector 101 is complete.

In this state, if the first connector 1 and/or the second connector 101 moves in the direction approaching the counterpart side, or in other words, the mating direction, the first protruding part 12 and first protruding end part 18 of the first connector 1 are inserted in the recessed groove part 112*a* and mating recessed part 122 of the second connector 101. This results in the state as illustrated in FIG. 6B, and the mating of the first connector 1 and the second connector 101 is completed. Furthermore, the first terminals 61 and the second terminals 161 are placed in a conductive state.

Thus, in the present embodiment, the first connector 1 is provided with the first housing 11 and a plurality of first terminals 61 that are mounted in the first housing 11; the first housing 11 is a member integrated with the first terminals 61 by means of insert molding, and includes the first protruding part 12 that extends in the longitudinal direction thereof and retains the first terminals 61, and the flange 17*b* that protrudes outwardly in the width direction from the outer surface 12*b* and the inner surface 12*c* of the first protruding part 12 at the mounting surface side end of the first housing 11; the first terminals 61 include the standing part 65 that is exposed on the surface 65*b* from the outer surface 12*b* and the inner surface 12*c* of the first protruding part 12 and the tail part 62 connected to the mounting surface side end of the standing part 65 via the curved connecting part 63, and such that the tail part 62 extends outwardly in the width direction from the flange 17*b* and is soldered to the substrate; the flange 17*b* includes the notch 17*c* formed at a location corresponding to each of the first terminals 61; such that at least one part of the tail part 62, curved connecting part 63, and surfaces 62*a*, 63*a*, and 65*b* of the standing part 65 are exposed at the notch 17*c*.

This enables easier manufacturing of the first connector 1, prevents short molding from occurring, prevents flux from adhering to the contact recessed part 65*a* of the first terminals 61, enables miniaturization, and improves the reliability of the first connector 1.

In addition, a contiguous corner is formed from the lower surface 62*d* of the tail part 62 to the upper surface 17*b*1 of the flange 17*b*, passing through the notch 17*c*. Furthermore, the corner is the intersecting point of two surfaces that intersect each other. Moreover, the corners are passages through which flux passes during soldering of the tail part 62. Even more, a side surface recessed part 12*d* is formed between mutually adjacent standing parts 65 on the outer surface 12*b* and the inner surface 12*c* of the first protruding part 12. In addition, the bottom surface 12*d*2 of the side surface recessed part 12*d* is flush with the upper surface 17*b*1 of the flange 17*b*. Furthermore, flux is collected in the side surface recessed part 12*d* during soldering of the tail part 62.

Note that the disclosure herein describes features relating to suitable exemplary embodiments. Various other embodiments, modifications, and variations within the scope and spirit of Scope of the Patent Claims appended hereto will naturally be conceived of by those skilled in the art upon review of the disclosure herein. For example, the staggered arrangement of the terminals does not have to be regular. In addition, the arrangement of the terminals on the left and right half body parts need not be the same. Furthermore, the left and right half body parts need not be axially symmetric.

The present disclosure can be applied to a connector and a connector pair.

The invention claimed is:

1. A connector comprising:

a connector main body; and a plurality of terminals attached to the connector body, wherein the connector main body is a member integrated with the terminals by insert molding, and includes a protruding part extending in the longitudinal direction thereof that retains the terminals, and a flange protruding outward in the width direction from a side surface of the protruding part at a mounting surface side end of the connector body, wherein the terminal includes a standing part in which a surface is exposed on the side surface of the protruding part, and a tail part connected to the mounting surface side end of the standing part via a curved connecting part, extending outward in the width direction from the flange, and soldered to a substrate, and wherein the flange includes a notch formed at a location corresponding to each terminal, and at least a part of a surface of the tail part, the curved connecting part, and the standing part is exposed at the notch.

2. The connector according to claim 1, wherein a size of the notch is narrower in the longitudinal direction than a size of at least one of the standing part, the curved connecting part, or the tail part of the terminal in the longitudinal direction.

3. The connector according to claim 1, wherein a contiguous corner is formed from the tail part to the upper surface of the flange and passes through the notch.

4. The connector according to claim 3, wherein the corner is an intersection of two surfaces that intersect each other.

5. The connector according to claim 1, wherein a recessed part is formed between mutually adjacent standing parts on the side surface of the protruding part.

6. The connector according to claim 5, wherein the bottom surface of the recessed part is flush with the top surface.

7. A connector comprising:

a connector main body; and a plurality of terminals attached to the connector body, wherein the connector main body is a member integrated with the terminals by insert molding, and includes a protruding part extending in the longitudinal direction thereof that retains the terminals, and a flange protruding outward in the width direction from a side surface of the protruding part at a mounting surface side end of the connector body, wherein each terminal includes a standing part in which a surface is exposed on the side surface of the protruding part, and a tail part connected to the mounting surface side end of the standing part via a curved connecting part, extending outward in the width direction from the flange, and soldered to a substrate, wherein a recessed part is formed on the side surface of the protruding part between adjacent standing parts of adjacent terminals, and wherein a bottom surface of the recessed part is flush with a top surface of the flange.

8. The connector according to claim 7, wherein the standing part includes a contact part in contact with a mating terminal of the mating connector, and wherein the contact part is separated from the upper surface of the flange.

9. A connector pair, comprising a connector according to claim 7, and a mating connector that mates with such connector.

10. The connector according to claim 1, wherein the standing part includes a contact part in contact with a mating terminal of the mating connector, and wherein the contact part is separated from the upper surface of the flange.

11. A connector pair, comprising a connector according to claim 1, and a mating connector that mates with such connector.

12. The connector according to claim 1, wherein a side surface of the flange formed by the notch intersects with the surface of the tail part.

* * * * *